United States Patent [19]

Kajimura et al.

[11] Patent Number: 4,640,817

[45] Date of Patent: Feb. 3, 1987

[54] DUAL-PHASE STAINLESS STEEL WITH IMPROVED RESISTANCE TO CORROSION BY NITRIC ACID

[75] Inventors: Haruhiko Kajimura, Nishinomiya; Hiroo Nagano; Minoru Miura, both of Kobe, all of Japan

[73] Assignee: Sumitomo Metal Industries, Ltd., Osaka, Japan

[21] Appl. No.: 635,108

[22] Filed: Jul. 27, 1984

[30] Foreign Application Priority Data

Aug. 5, 1983 [JP] Japan ..... 58-142518

[51] Int. Cl.[4] ..... C22C 38/40

[52] U.S. Cl. ..... 420/50; 420/56; 420/98; 420/59; 148/325; 148/327

[58] Field of Search ..... 148/38, 37; 75/128 N, 75/128 G, 128 T, 128 C

[56] References Cited

U.S. PATENT DOCUMENTS

| | | | |
|---|---|---|---|
| 2,051,415 | 8/1936 | Payson | 148/37 |
| 2,083,524 | 6/1937 | Payson | 148/37 |
| 3,337,331 | 9/1983 | Ljungberg | 148/38 |
| 3,785,787 | 1/1974 | Yokota et al. | 75/128 C |
| 4,002,510 | 1/1977 | Wilde | 148/38 |
| 4,032,367 | 6/1977 | Richardson | 75/128 C |
| 4,171,218 | 10/1979 | Hoshino et al. | 75/128 Z |
| 4,279,648 | 7/1981 | Ito et al. | 75/128 A |

FOREIGN PATENT DOCUMENTS

| | | | |
|---|---|---|---|
| 679421 | 7/1939 | Fed. Rep. of Germany . | |
| 725887 | 8/1942 | Fed. Rep. of Germany . | |
| Ad.49211 | of 0000 | France . | |
| 803361 | 9/1935 | France . | |
| 56-29657 | 3/1981 | Japan | 75/128 C |
| 103220 | 10/1941 | Sweden . | |
| 216729 | 9/1941 | Switzerland . | |

OTHER PUBLICATIONS

Sandvik 3RE60 Technical Report (1967).

Sandvik 3RE60 Technical Report (Jun. 1970).

Werkstoffe und Korrosion [Materials and Corrosion], Carlen, p. 646 (1970).

Colombier-Hochmann: "Proprietes Generales des Aciers Inoxydables", Verlag Duned, 1955, Erate Auflage, Kapitel D, Seite 131-139, Les Aciers Austeno-Ferritiques.

*Primary Examiner*—L. Dewayne Rutledge

*Assistant Examiner*—Deborah Yee

*Attorney, Agent, or Firm*—Burns, Doane, Swecker & Mathis

[57] ABSTRACT

A dual-phase stainless steel exhibiting improved resistance to corrosion caused by nitric acid is disclosed, which consists essentially of:

C: not more than 0.02% by weight, Si: 2-6% by weight,

Mn: 0.1-2% by weight, Cr: 20-35% by weight,

Ni: 3-27% by weight, P: not more than 0.02% by weight,

N: not more than 0.30% by weight,

Fe and incidental impurities: balance the amount of ferrite to be 30-70% by volume.

14 Claims, 4 Drawing Figures

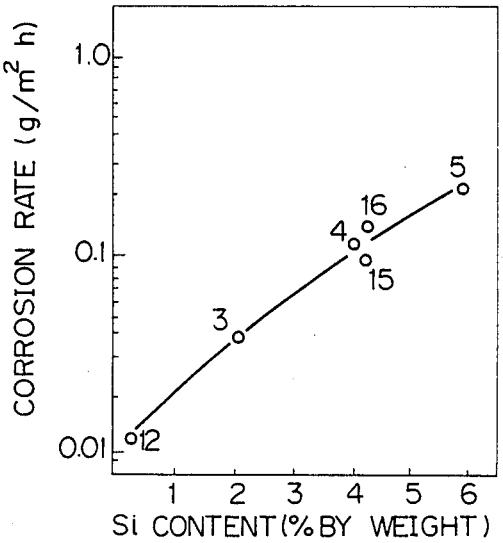
Fig. 3
Fig. 4
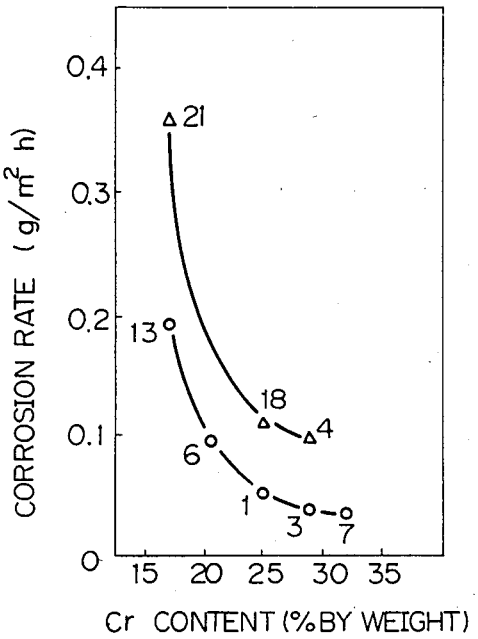

DUAL-PHASE STAINLESS STEEL WITH IMPROVED RESISTANCE TO CORROSION BY NITRIC ACID

BACKGROUND OF THE INVENTION

This invention relates to a dual-phase stainless steel exhibiting improved resistance to corrosion caused by nitric acid, and particularly to such a dual-phase stainless steel as that used for structural members in the construction of an apparatus for chemically reprocessing spent nuclear fuels.

Chemical treatment of the spent nuclear fuel of light-water reactors is carried out under high temperature, nitric acid-containing environments, and such 25% Cr-20% Ni base alloys as URANUS 65 (tradename) have been used as a structual material therefor. However, the degree of corrosion resistance which 25% Cr-20% Ni base alloys exhibit is not satisfactory under medium or high concentrations of nitric acid or when the corrosive environment further contains $Cr^{6+}$ ions. It has also been proposed to use 17% Cr-14% Ni-4% Si base steels and 8% Cr-20% Ni-6% Si base steels under such highly corrosive environments, although these materials do not exhibit satisfactory resistance to corrosion even under conditions containing high or medium concentrations of nitric acid, either. Even more they do not exhibit corrosion resistance under environments where $Cr^{6+}$ ions are also contained, since the $Cr^{6+}$ ions act as an oxidizing agent to markedly accelerate the intergranular corrosion.

Dual-phase stainless steels such as 27% Cr-8% Ni-0.1% N base alloys have been proposed as steels highly resistant against nitric acid (See Japan Laid-Open Patent Specification No. 31068/1983). However, silicon is added in an amount of up to 2% merely as a deoxidizing agent and they do not exhibit satisfactory resistance under corrosive conditions containing an oxidizing agent such as $Cr^{6+}$ ions.

Thus, a metallic material which exhibits satisfactory levels of corrosion resistance in the presence of $Cr^{6+}$ ions in nitric acid solutions has not yet been developed.

Now many nuclear power plants are in operation, and a relatively large amount of the total power supply has come from light-water nuclear reactors. It has also been necessary to reprocess a large amount of the spent nuclear fuels from these reactors with nitric acid solutions. What this means is that there is a need in the art for a material which can exhibit improved resistance to corrosion under nitric acid-containing environments. It is also required that structural members for an apparatus used in reprocessing spent nuclear fuels, having a long, continuous service life be provided.

Materials and articles made thereof which meet the above needs should satisfy the following requirements:

(1) First, they must exhibit improved resistance to corrosion, particularly to corrosion by nitric acid;

(2) Second, they must also exhibit satisfactory resistance against any increase in corrosion rates or acceleration of intergranular corrosion, which are caused by increases in corrosion potential due to contamination from $Cr^{6+}$ ions or from an oxidizing agent from nuclear fuels such as Ru; and (3) Third, they must suppress any degradation in the corrosion resistance of welds by avoiding becoming sensitized during welding. This is because welding is widely used in the construction of these apparatuses.

OBJECT OF THE INVENTION

The object of this invention is to provide a dual-phase stainless steel and an article made thereof for use in the construction of an apparatus for reprocessing spent nuclear fuels, the material exhibiting not only improved weldability, but also improved corrosion resistance in the presence or absence of an oxidizing agent such as $Cr^{6+}$ ions in nitric acid solutions.

SUMMARY OF THE INVENTION

The inventors of this invention found that the corrosion resistance, particularly resistance to intergranular corrosion of 25% Cr-20% Ni base steel is markedly improved even in the presence of $Cr^{6+}$ ions under corrosive environments containing medium or high concentrations of nitric acid by adding Si in relatively large amounts while adjusting the amount of ferrite in the dual-phase structure to be 30–70% by volume by means of restricting the Cr and Ni content to some extent.

Thus, this invention resides in a dual-phase stainless steel exhibiting improved resistance to corrosion under nitric acid-containing conditions, which consists essentially, by weight, of:

C: not more than 0.04%, Si: 2 (exclusive) - 6%,
Mn: 0.1–2%, Cr: 20–35%,
Ni: 3–27%, P: not more than 0.02%, at least one of Nb, Ti and Ta in the total amount of 8×(C%) or more, but not more than 1.0%,
N: not more than 0.03%,
Fe: balance with incidental impurities, the amount of ferrite being 30–70% by volume.

In a preferable embodiment, the steel of this invention comprises 3–24% by weight of Ni and 20–28% by weight of Cr.

In a further preferable embodiment of this invention, the steel comprises 3–4% by weight of Si, 4–18% by weight of Ni and 22–26% by weight of Cr.

When carbon is 0.02% or less, there is no need to add the stabilizing elements such as Nb, Ti and Ta, and nitrogen is intentionally added in an amount of 0.30% or less.

Advantageously, the metallic materials of this invention are used under corrosive nitric acid-containing environments which further contain $Cr^{6+}$ ions acting as an oxidizing agent to accelerate the corrosion.

In another aspect, this invention resides in an article made of the metallic material mentioned above, which is used as a structural member for use in the construction of an apparatus for reprocessing spent nuclear fuels.

BRIEF DESCRIPTION OF THE DRAWINGS

FIG. 3 is a graph showing a relationship between the corrosion rate and the Si content; and FIG. 4 is a graph showing a relationship between the corrosion rate and the Cr content.

DETAILED DESCRIPTION OF THE PREFERRED EMBODIMENTS

Figure 1:
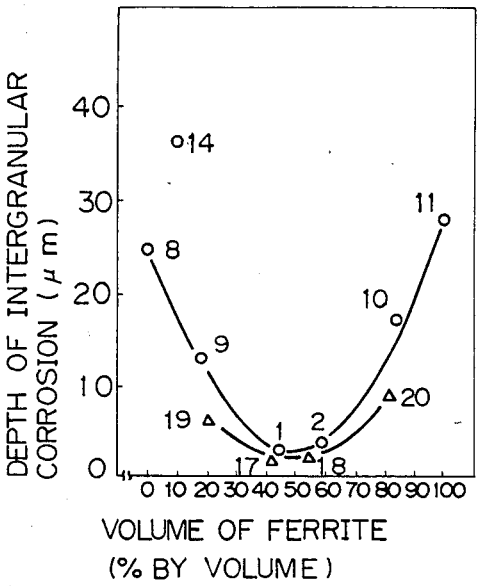
FIG. 1 is a graph showing a relationship between the corrosion resistance and the amount of ferrite.

The reasons why the steel composition of this invention is defined as in the above will be explained hereinafter in detail. Unless otherwise indicated, the term "%" means "% by weight" in this specification.

C (carbon):

Since carbon accelerates sensitiveness to intergranular corrosion, it is necessary to restrict the carbon content to a level as low as possible in order to improve the intergranular corrosion resistance. When carbon is added in an amount of more than 0.04%, the resistance to intergranular corrosion is not improved any more even if stabilizing agents such as Nb, Ti and Ta are added. Therefore, the upper limit of carbon is defined as 0.04%, preferably 0.02%. It is to be noted, however, that it is not necessary to incorporate such a stabilizing element when the carbon content is 0.02% or less, preferably 0.01% or less.

Si (silicon):

It is necessary to incorporate more than 2% of silicon, preferably 2.5% or more of silicon in order to achieve satisfactory corrosion resistance even under environments of nitric acid solutions containing $Cr^{6+}$ ions. Whereas since in a mere nitric acid solution which is free of contamination from $Cr^{6+}$ ions the corrosion resistance will be degraded as the silicon content increases, the upper limit of the silicon is defined as 6% in this invention. In a specific example, the Si content may be restricted to 3–4% by weight.

Mn (manganese):

Manganese is added in an amount of 0.1–2% as a deoxidizing agent.

Cr (chromium):

In order to improve the corrosion resistance of a high Si material in a nitric acid solution, it is necessary to increase the amount of chromium as well as that of silicon.

According to this invention, therefore, it is desirable to add chromium in an amount of 20% or more. When chromium is added in an amount of more than 35%, weldability deteriorates and manufacturing costs increase. The upper limit of chromium is, therefore, defined as 35% in this invention. Advantageously, the Cr content is 20–28%, preferably 20–26%. More advantageously, it is 22–26% by weight.

Ni (nickel):

It is necessary to incorporate nickel in an amount of 3–27% so as to provide a dual-phase structure having 30–70% by volume of ferrite. The nickel balance [Ni(bal)] required to provide 30–70% by volume is from −23 to −12; $-23 \leqq Ni(bal) \leqq -12$ wherein the nickel balance is defined as follows:

$$Ni(bal) = 30 \times [C(\%) + N(\%)] + 0.5 \times Mn(\%) + Ni(\%) + 11.6 - 1.36 \times [1.5 \times Si(\%) + Cr(\%)]$$

The nickel content is desirably 3–24% by weight, more desirably 4–18% by weight.

N (nitrogen):

Nitrogen is present in an amount of not more than 0.03% as incidental impurities. However, when the stabilizing elements such as Nb, Ti, Ta are not added, nitrogen is intentionally added in an amount of 0.30% or less as an austenite former. The upper limit is defined as 0.30% from the standpoint of manufacturing, too.

Nb, Ti, Ta (niobium, titanium, tantalum):

These elements may stabilize the carbon in a steel to improve the intergranular corrosion resistance. For this purpose, at least one of Nb, Ti, and Ta is added in the total amount of eight times or more, preferably ten times or more of the carbon content, C(%). However, in view of the required level of weldability the upper limit of these elements is 1.0%. In addition, since these elements are added to stabilize carbon, there is no need to incorporate them when the carbon content is not more than 0.02%.

P (phosphorous):

It is desirable to limit the phosphorous content to a level as low as possible so as to improve the intergranular corrosion resistance. Acccordingly, the phosphorous content is restricted to 0.02% or less.

The following examples are presented as specific illustrations of this invention. It should be understood, however, that this invention is not limited to the specific details set forth in the examples.

EXAMPLES

A variety of steels having the steel compositions shown in Table 1 below were prepared and were subjected to heat treatment under conditions including heating at 1100° C. for 30 minutes followed by water cooling. The resulting test steels were then further subjected to a corrosion test using a nitric acid solution in the presence or absence of $Cr^{6+}$ ions. The corrosion test was carried out in a 8N-$HNO_3$ nitric acid solution and in a 8N-$HNO_3$ solution containing $Cr^{6+}$ ions. The test pieces were immersed into a boiling solution of these nitric acid solutions for 48 hours.

The test results are summarized by the graphs in FIGS. 1 through 4. Numeral reference figures in these graphs indicate the steel numbers shown in Table 1.

FIG. 1 is a graph showing the influence of the amount of ferrite on intergranular corrosion for 25% Cr-2.5% Si and 25% Cr-4% Si steel materials as shown by the symbols "O" and "Δ", respectively. It is noted from the data shown therein that the minimum depth in intergranular corrosion comes when the amount of ferrite is 30–70% by volume. In terms of the nickel balance, it is said that the nickel balance defined hereinbefore should be −23 to −12 so that the ferrite is provided in an amount of 30–70% by volume.

Figure 2:
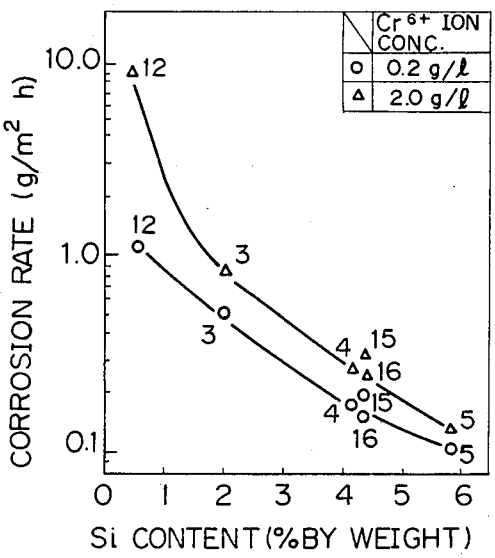
FIG. 2 is a graph showing a relationship between the corrosion rate and the Si content.

FIG. 2 is a graph showing the influence of the Si content on the corrosion rate in an 8N-$HNO_3$ solution containing $Cr^{6+}$ ions for 28% Cr base dual-phase stainless steels. As is apparent from the graphs, it is necessary to add silicon in an amount of more than 2%, preferably 2.5% or more in order for a satisfactory level of resistance to nitric acid corrosion to be exhibited for each of the cases wherein the chromium ion concentrations are 0.2 g/l and 2.0 g/l of $Cr^{6+}$ ions, respectively. In the figure, the symbol "0" indicates the case where the $Cr^{6+}$ ion concentration is 0.2 g/l and the symbol "Δ" indicates the case where the concentration is 2.0 g/l.

FIG. 3 shows a relationship between the corrosion rate and the silicon content in an 8N-$NHO_3$ solution for 28% Cr base dual-phase stainless steels. It is apparent from the graph that the corrosion rate increases as the silicon content increases. Therefore, the upper limit of the silicon content is defined as 6% in this invention.

FIG. 4 is also a graph showing an influence of the Cr content on the corrosion rate in an 8N-$NHO_3$ solution for 2.5% Si-test steel materials as well as 4% Si-test steel materials. Though the amount of the Si added is as small as 2.5%, the corrosion rate is markedly decreased when 20% or more of Cr is added.

Although this invention has been described with preferred embodiments it is to be understood that variations and modifications may be employed without departing from the concept of the invention as defined in the following claims.

TABLE (% by weight)

| Steel No. | C | Si | Mn | P | S | Ni | Cr | Nb | Ti | Ta | N | Ferrite (% by volume) | Remarks |
|---|---|---|---|---|---|---|---|---|---|---|---|---|---|
| 1 | 0.007 | 2.52 | 0.67 | 0.013 | 0.002 | 10.27 | 25.01 | 0.24 | — | — | 0.012 | 42.3 | Inven- |
| 2 | 0.008 | 2.56 | 0.61 | 0.012 | 0.001 | 8.28 | 24.97 | — | 0.25 | — | 0.018 | 57.5 | tion |
| 3 | 0.010 | 2.58 | 0.62 | 0.014 | 0.002 | 9.12 | 28.27 | 0.26 | — | — | 0.010 | 61.2 | |
| 4 | 0.011 | 4.11 | 0.58 | 0.013 | 0.001 | 12.20 | 28.16 | 0.24 | — | — | 0.015 | 68.1 | |
| 5 | 0.010 | 5.87 | 0.63 | 0.013 | 0.002 | 16.18 | 28.21 | 0.28 | — | — | 0.016 | 65.0 | |
| 6 | 0.009 | 2.57 | 0.62 | 0.012 | 0.002 | 5.12 | 21.22 | — | — | 0.28 | 0.018 | 51.5 | |
| 7 | 0.009 | 2.53 | 0.65 | 0.014 | 0.002 | 14.16 | 32.31 | 0.27 | — | — | 0.017 | 64.8 | |
| 8 | 0.008 | 2.53 | 0.67 | 0.013 | 0.002 | 24.17 | 24.96 | 0.24 | — | — | 0.020 | 0* | Compar- |
| 9 | 0.011 | 2.58 | 0.66 | 0.012 | 0.001 | 17.48 | 24.89 | 0.25 | — | — | 0.019 | 19.5* | ative |
| 10 | 0.010 | 2.53 | 0.65 | 0.014 | 0.001 | 5.01 | 25.03 | 0.26 | — | — | 0.018 | 83.1* | |
| 11 | 0.011 | 2.57 | 0.68 | 0.014 | 0.002 | 0.32* | 24.91 | 0.28 | — | — | 0.019 | 100* | |
| 12 | 0.012 | 0.25* | 0.67 | 0.013 | 0.002 | 8.31 | 28.21 | 0.26 | — | — | 0.020 | 48.1 | |
| 13 | 0.009 | 2.51 | 0.66 | 0.012 | 0.002 | 3.50 | 16.76* | 0.27 | — | — | 0.018 | 67.9 | |
| 14 | 0.045* | 2.56 | 0.63 | 0.013 | 0.001 | 17.27 | 25.10 | 0.52 | — | — | 0.021 | 12.6* | |
| 15 | 0.031 | 4.24 | 0.65 | 0.013 | 0.001 | 12.15 | 28.10 | 0.37 | — | — | 0.012 | 60.3 | Inven- |
| 16 | 0.010 | 4.21 | 0.63 | 0.014 | 0.001 | 12.30 | 28.26 | — | — | — | 0.19 | 47.6 | tion |
| 17 | 0.015 | 3.98 | 0.66 | 0.010 | 0.001 | 9.25 | 25.06 | — | — | — | 0.18 | 42.7 | |
| 18 | 0.012 | 3.81 | 0.65 | 0.013 | 0.001 | 7.76 | 25.20 | — | — | — | 0.17 | 55.9 | |
| 19 | 0.011 | 3.95 | 0.64 | 0.012 | 0.002 | 12.15 | 24.85 | — | — | — | 0.17 | 21.5* | Compar- |
| 20 | 0.010 | 3.87 | 0.63 | 0.014 | 0.001 | 3.62 | 25.15 | — | — | — | 0.19 | 80.2* | ative |
| 21 | 0.012 | 3.90 | 0.61 | 0.013 | 0.001 | 3.50 | 16.51* | — | — | — | 0.15 | 48.1 | |

Note
*Outside the range of this invention.

What is claimed is:

1. A dual phase stainless steel exhibiting improved resistance to corrosion caused by nitric acid, which consists essentially of:

C: not more than 0.02% by weight;

Si: more than 2% by weight, but not more than 6% by weight;

Mn: 0.1–2% by weight; Cr: 22–35% by weight;

Ni: 3–27% by weight; P: not more than 0.02% by weight;

N: not more than 0.30 by weight;

Fe and incidental impurities: balance; and wherein the amount of ferrite is 30–70% by volume.

2. A dual-phase stainless steel exhibiting improved resistance to corrosion caused by nitric acid, as defined in claim 1, in which:

Si: 2.5–6% by weight.

3. A dual-phase stainless steel exhibiting improved corrosion resistance caused by nitric acid, as defined in claim 1, in which:

Si: 3–4% by weight.

4. A dual phase stainless steel as defined in claim 1, in which:

Cr: 22–28% by weight, and Ni: 3–24% by weight.

5. A dual-phase stainless steel as defined in claim 1, in which:

Cr: 22–26% by weight, and Ni: 4–18% by weight.

6. A dual-stainless steel as defined in claim 1, in which:

Si: 3–4% by weight,

Cr: 22–26% by weight, and Ni: 4–18% by weight.

7. A dual-phase stainless steel exhibiting improved resistance to corrosion caused by nitric acid, which consists essentially, by weight, of:

C: not more than 0.04%; Si: 2(exclusive) - 6%;

Mn: 0.1–2%; Cr: 22–35%;

Ni: 3–27%; P: not more than 0.02%; at least one of Nb, Ti and Ta in the total amount of $8\times C(\%)$ or more, but not more than 1.0%;

N: not more than 0.03%;

Fe and incidental impurities: balance; and wherein the amount of ferrite is 30–70% by volume.

8. A dual-phase stainless steel exhibiting improved resistance to corrosion caused by nitric acid, as defined in claim 7, in which the total amount of at least one of Nb, Ti and Ta is $10\times C(\%)$ or more, but not more than 1.0%.

9. A dual-phase stainless steel exhibiting improved resistance to corrosion caused by nitric acid, as defined in claim 7, in which:

Si: 2.5–6% by weight.

10. A dual-phase stainless steel exhibiting improved corrosion resistance caused by nitric acid, as defined in claim 7, in which:

Si: 3–4% by weight.

11. A dual-phase stainless steel as defined in claim 7, in which:

Cr: 22–28% by weight, and Ni: 3–24% by weight.

12. A dual-phase stainless steel as defined in claim 7, in which:

Cr: 22–26% by weight, and Ni: 4–18% by weight.

13. A dual-phase stainless steel as defined in claim 7, in which:

Si: 3–4% by weight,

Cr: 22–26% by weight, and Ni: 4–18% by weight.

14. An article useful as a structural member for use in the construction of an apparatus for reprocessing spent nuclear fuels, said member being made of a dual-phase stainless steel which consists essentially of:

C: not more than 0.04% by weight;

Si: 2(exclusive) - 6% by weight;

Mn: 0.1–2% by weight; Cr: 22–35% by weight;

Ni: 3–27% by weight at least one of Nb, Ti and Ta in the total amount of 0 to 1.0% by weight;

N: 0–0.30% by weight;

Fe and incidental impurities: balance; and wherein the amount of ferrite 30–70% by volume.

* * * * *